United States Patent [19]

Wisdom et al.

[11] Patent Number: 4,648,296

[45] Date of Patent: Mar. 10, 1987

[54] METHOD AND APPARATUS FOR FEEDING SLICERS

[75] Inventors: Lawrence W. Wisdom, Dallas; Ponnattu K. Joseph, Irving, both of Tex.

[73] Assignee: Frito-Lay Inc., Dallas, Tex.

[21] Appl. No.: 675,010

[22] Filed: Nov. 26, 1984

[51] Int. Cl.[4] ..... B26D 3/28

[52] U.S. Cl. ..... 83/13; 83/403; 83/404.3; 83/409.2; 83/411 A; 83/705

[58] Field of Search ..... 83/13, 403, 404.2, 404.3, 83/408, 763, 705, 409.2, 417, 733, 411 A, 411 R, 404.4

[56] References Cited

U.S. PATENT DOCUMENTS

| | | | |
|---|---|---|---|
| 820,762 | 5/1906 | Boutell | 83/163 |
| 2,195,879 | 4/1940 | Urschel et al. | 146/165 |
| 2,923,337 | 2/1960 | Jouin | 83/417 |
| 3,139,127 | 6/1964 | Urschel et al. | 146/78 |
| 3,139,128 | 6/1964 | Urschel et al. | 146/78 |
| 3,139,129 | 6/1964 | Urschel et al. | 146/241 |
| 3,139,130 | 6/1964 | Urschel et al. | 146/241 |
| 3,251,389 | 5/1966 | Urschel et al. | 146/239 |
| 3,251,557 | 5/1966 | Urschel et al. | 241/5 |

OTHER PUBLICATIONS

"Urschel Model CC Slicer", Urschel Laboratories, Incorporated.

*Primary Examiner*—James M. Meister
*Assistant Examiner*—Hien H. Phan
*Attorney, Agent, or Firm*—Bernard, Rothwell & Brown

[57] ABSTRACT

A centrifugal slicer is provided with an in-feed apparatus for feeding one item of produce at a time to be sliced. The in-feed apparatus includes a block with a channel having an inlet at the center of the slicer impeller for gravity feed of items to be sliced to an outlet located at a single area on the periphery of the slicer impeller.

7 Claims, 2 Drawing Figures

METHOD AND APPARATUS FOR FEEDING SLICERS

BACKGROUND OF THE INVENTION

1. Field of the Invention

This invention relates to improvements in a method and apparatus for feeding whole produce to centrifugal slicers.

2. Prior Art

Centrifugal slicers for slicing whole produce are well known in the art. One commercially available slicer is the URSCHEL Model CC slicer manufactured and sold by Urschel Laboratories, Inc., Valparaiso, Ind. Although the URSCHEL Model CC centrifugal slicer was designed with potato chips as a primary consideration, it is also capable of producing slices from a wide variety of other products, including raw apples, beets, mushrooms, etc.

In the operation of a centrifugal slicer such as the URSCHEL Model CC, produce enters a rotating impeller and is forced against the inner surface of a slicing head assembly, which consists of eight separate slicing heads and knives. As produce passes each knife in a smooth and uninterrupted manner a slice is produced, thus a multiplicity of slices can be produced within a very short period of time.

In the production of certain products, e.g., apple chips, it is highly desirable to monolayer the slices after they are sliced. That is, individual slices should be lying flat on a conveyor and not overlapped or piled on top of one another. When this occurs, clumping is virtually eliminated and finished product quality is at its optimum.

While a centrifugal slicer such as the URSCHEL Model CC works well on apples, the throughput is difficult to monolayer if more than one apple is sliced at a time. Because of the speed with which the centrifugal impeller must rotate, even if one attempts to reduce capacity by having only one outlet, it is still difficult to capture and monolayer the slices from that one outlet.

Accordingly, there is a need in the art to provide a centrifugal slicer having the advantages of known centrifugal slicers and yet having a reduced throughput so that the throughput slices can be caught and monolayered.

The slicer blades should encounter the produce to be sliced only at regular intervals to prevent overlapping of the output from each blade. This requires that only one unit of produce be present in the slicer at a time, a new one to be fed only after the previous one is fully sliced.

Conventional techniques of feeding the slicer to satisfy the above constraint will require timing the in-feed at regular intervals. This interval should be the time taken to slice the largest unit of produce rather than the average size unit of produce to avoid overlapping of the output.

This results in capacity reduction that can best be overcome by the simple and fully reliable invention disclosed herein. The slice quality in terms of thickness, uniformity and level of scrap is superior since the produce no longer moves around in the slicer. The speed of the slicer can also now be moderately adjusted to suit downstream processing requirements as would arise in any practical manufacturing operation, without deterioration of slice quality.

SUMMARY OF THE INVENTION

This invention involves a method of feeding a centrifugal slicer of the type having a high speed rotary cup-like impeller utilizing single file feeding of items of produce to the center and then radially within the impeller and forcing the foremost of the single file line of produce items into a plurality of slicing knives located outside the periphery of the impeller. This method is accomplished by apparatus having a feed channel with a dimension to hold the items of produce in single file fashion, the feed channel extending into the center of the rotary impeller and then extending outwardly to the edge of the impeller so as to present single items of produce at an exit of the channel positioned at the periphery of the impeller so that the items will be sliced one at a time by contacting the knives during rotation of the impeller.

DETAILED DESCRIPTION OF THE PREFERRED EMBODIMENT

Figure 1:
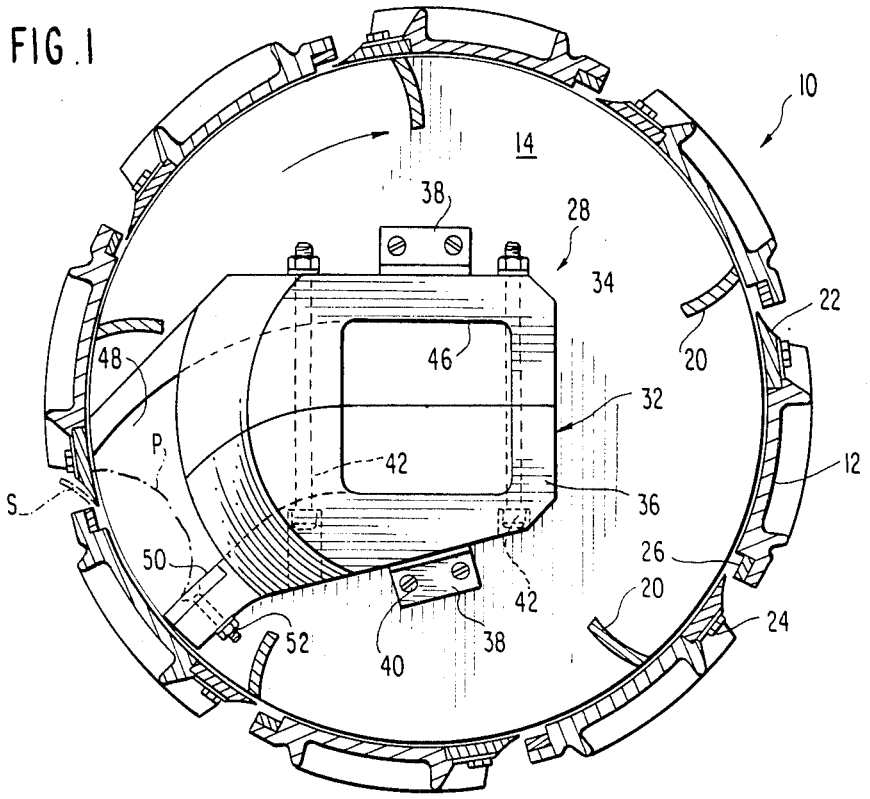
FIG. 1 is a top plan view of the apparatus of this invention as applied to a centrifugal slicer.

A centrifugal slicer such as the URSCHEL Model CC Slicer 10 manufactured by Urschel Laboratories, Inc. of Valparaiso, Ind. includes a stationary slicing head assembly 12 which forms a generally cup-shaped enclosure within which an impeller 14 is rotatable by a driveshaft 16 from a suitable drive 18. The other components of the centrifugal slicer are those which are well known and exist on the market. Therefore, only those components necessary for an understanding of this invention will be described.

The impeller carries a plurality of blades 20, and in the URSCHEL Model CC slicer there are five such blades. In such slicers each blade pushes in front of it an individual product P such as a potato to be sliced by forcing each potato against a plurality of stationary knives 22. In the URSCHEL Model CC slicer there are eight knives on the slicing head assembly each of which is suitably held in place by a knife clamp 24. There are eight corresponding gate inserts 26 so that in normal operation the impeller blades 20 are forcing five potatoes at a time around the periphery to be sliced by eight different slicing knives so that a plurality of slices S pass outwardly between the gate inserts 26 and the knives 22. What has been described is the URSCHEL Model CC slicer which rotates in the direction as indicated by the arrow in FIG. 1 to accomplish high speed, high throughput centrifugal slicing of potatoes and other produce.

This invention modifies a centrifugal slicer in connection with the in-feed so as to provide reduced throughput with the same speed of rotation of the impeller, thereby slicing only one item of produce at a time. More particularly, a centrifugal slicer is provided with an in-feed means 28 beneath a feed tube 30. The feed tube is centered over the center of the slicer impeller 14, but may be swung away for access to the impeller. Individual items of produce may be fed down the feed tube by gravity from any suitable source such as a hopper or the like. The diameter of the feed tube is chosen so that the items to be sliced are fed single file.

Figure 2:
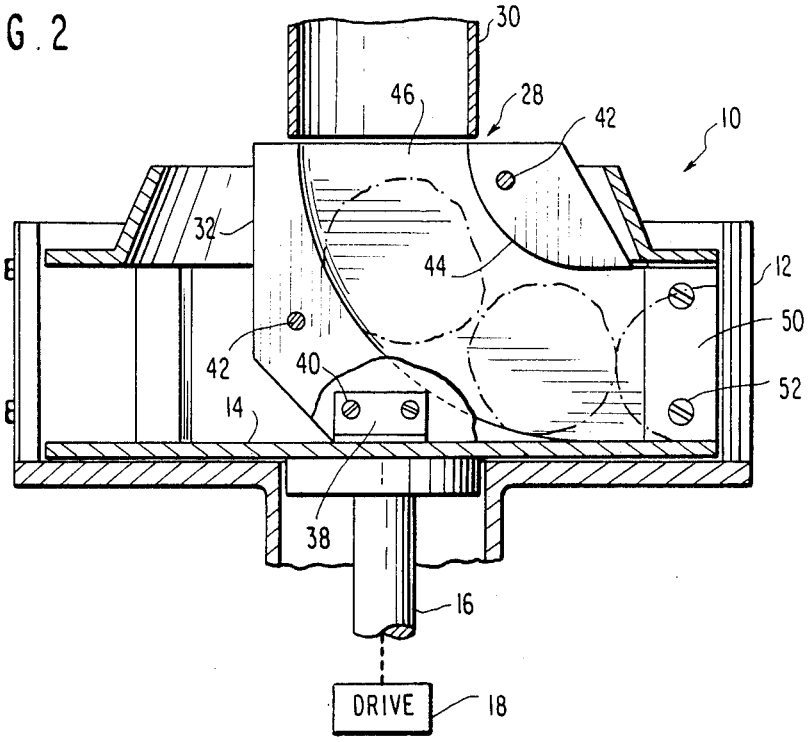
FIG. 2 is a sectional elevation view of the apparatus of this invention as applied to the centrifugal slicer.

Below the feed tube 30 and fastened to the impeller face is a feed block 32. This block is made up of two molded plastic halves 34 and 36 which fit together. Each half is secured to the face of the impeller 14 by a bracket 38 and suitable screws 40. The two halves are held together, in mating relationship by nut and bolt combinations 42. When assembled the feed block defines a passageway 44 therein. This passageway has a top opening 46 which is centered with the center of the impeller and an outlet opening 48 at the periphery of the impeller. The passageway 44 curves when viewed in a horizontal plane opposite the movement of the impeller as shown in FIG. 1 and curves from the vertical to the horizontal as viewed in FIG. 2. A pusher plate 50 of metal or other hardened material is attached to the molded plastic feed block half 36 by suitable nut and bolt combination 52 to push the items of produce P onto the knives 22 to create the slices S at each knife position. The passageway 44 is also of an internal dimension so as to allow the items of produce to be fed in single file fashion, i.e., so that single items of produce can be fed without jamming.

With this invention the impeller of the centrifugal slicer can be rotated at its maximum speed to eliminate waste, i.e., about 250 r.p.m, and products such as apples (although not limited thereto) may be fed through the passageway 44 in single file fashion by the force of gravity. During high speed rotation of the impeller 14 the items of produce P are pushed onto the knives 22 and slices are generated to be then captured and monolayered at a speed which the processing apparatus downstream of the slicer can handle. In other words, the throughput of a conventional slicer is reduced by this invention to coordinate the throughput with the speed of processing equipment downstream of the slicer.

By curving the passageway 44 when viewed in plane, i.e., as seen in FIG. 1, there is produced an angle less than or equal to 90° with each knife 22 in the same manner that the blades 20 of the unmodified impeller would provide.

If the slicer is used in its conventional mode, the in-feed means 28 would simply be removed. This invention is highly desirable and could be used in conjunction with a monolayering apparatus disclosed in commonly owned application Ser. No. 544,971, filed Oct. 24, 1983, now abandoned in favor of continuation-in-part application Ser. No. 713,896, filed Mar. 20, 1985.

What is claimed is:

1. A method of feeding a centrifugal slicer of the type having a rotary impeller with a plurality of blades, which impeller cooperates with a stationary member having a plurality of slicing knives, the method comprising:

(a) feeding a plurality of produce items vertically and downwardly in a single file line and in abutting relationship towards the center of the cup-like impeller and then along an inclined path from a vertical direction to a horizontal direction, while (b) forcing the first in line of the single file line of produce items to the periphery of the rotary impeller.

2. A method as in claim 1 wherein the feeding and forcing are accomplished by gravity and centrifugal force, respectively.

3. An apparatus for automatically feeding individual items of produce in succession to a centrifugal slicer of the type having a rotary impeller with an axial center for normally receiving a plurality of items to be sliced, and a stationary slicing head assembly having a plurality of knives, the apparatus comprising:

(a) an in-feed means for feeding the items vertically and downwardly, the in-feed means having a passageway with a dimension to feed the items in single file relationship, (b) the passageway shaped and positioned to extend and incline along a curved path from a vertical direction at the axial center of the rotary impeller to a horizontal direction outwardly therefrom, and (c) an exit of the passageway positioned at the periphery of the impeller so as to feed only one item of produce at a time in a horizontal direction for slicing.

4. An apparatus as in claim 3 wherein the in-feed means includes a feed block which contains the passageway, the feed block being secured to the impeller to rotate therewith.

5. An apparatus as in claim 4 wherein the feed block is split-formed of a pair of rigidly assembled halves.

6. An apparatus as in claim 5 wherein the passageway in the feed block ends with a hardened pusher member for pushing the item to be sliced.

7. An apparatus as defined in claim 6 wherein an included angle between a face of the pusher member and each knife is less than or equal to 90°.

* * * * *